United States Patent [19]

[11] 3,956,967

Martz

[45] May 18, 1976

[54] TOGGLE RELEASE FOR LUGER PISTOL

[76] Inventor: John V. Martz, Rte. 2, Box 380, Lincoln, Calif. 95648

[22] Filed: Jan. 31, 1975

[21] Appl. No.: 546,107

[52] U.S. Cl. ..... 89/175; 89/148; 89/189

[51] Int. Cl.[2] ..... F41D 3/02

[58] Field of Search ..... 89/175, 138, 189, 148

[56] References Cited

UNITED STATES PATENTS

| | | | |
|---|---|---|---|
| 753,414 | 3/1904 | Luger | 89/175 X |
| 3,039,366 | 6/1962 | Imthurn et al. | 89/138 |
| 3,698,285 | 10/1972 | Wilhelm | 89/189 |

*Primary Examiner*—David H. Brown
*Attorney, Agent, or Firm*—Lothrop & West

[57] ABSTRACT

In a Luger pistol equipped with a toggle hold open mechanism, a small portion of one of the frame side rails is milled out in the vicinity of the sear bar slide to receive a new L-shaped release lever engageable at one end with the gun's hold open latch. The original sear bar slide is replaced by a modified form engageable with both the thumb safety lever and with the release lever in such manner that as the safety lever is moved to "safe" position, the release lever disengages the hold open latch from the breech block and allows the toggle mechanism to move forwardly and downwardly into closed position. Concurrently, the trigger mechanism is automatically locked against firing.

3 Claims, 6 Drawing Figures

TOGGLE RELEASE FOR LUGER PISTOL

BACKGROUND OF THE INVENTION

The device can be installed on any Luger pistol equipped with a hold open device, such as those guns produced in Germany during the years 1908 to 1942 and known as Model P.08.

In such model, the user is alerted to the fact that the gun has fired the last round from the magazine by the toggle's remaining in open, or buckled, position when the magazine has been emptied and the remaining shell in the firing chamber has been fired and ejected.

Heretofore, in order to restore the toggle assembly to closed position, it has been necessary to press the magazine release stud, remove the empty magazine from the butt of the pistol, grasp and forcefully pull up and back on the milled toggle knobs as far as the breech block will go and then release the knobs so that the recoil spring can drive the breech block straight ahead in its guide into locked position.

Gun collectors and fanciers appreciate the watch-like, or camera-like, precision of Luger pistols; but would often prefer that the toggle be selectively returnable to base position, once it has performed its warning function, by a simpler, more direct course of action than that recited above.

It is likewise most desirable to be able to release the toggle and simultaneously lock the trigger mechanism in the unlikely but possible event that the toggle prematurely remains in open position as a result of a weak or malfunctioning hold open catch spring.

SUMMARY OF THE INVENTION

The invention relates generally to improvements in the construction of Model P.08 Luger pistols and, more particularly, to mechanism for releasing the toggle train of such guns without removing the magazine, and for simultaneously rendering the gun safe by a simple movement of the thumb safety lever from "fire" to "safe" position.

It is an object of the invention to provide a toggle release mechanism which fits entirely within the existing interior confines of a Model P.08 Luger pistol and which therefore does not alter the exterior appearance of the gun in any way.

It is another object of the invention to provide a device in which a single movement not only actuates the existing trigger lock mechanism but also releases the toggle, and which requires only one minor machining operation on a side rail of the gun frame, three simple modifications to existing gun components and one small new part.

It is still another object of the invention to provide a toggle release which becomes operative in the event a malfunctioning, or weak, hold open latch spring prematurely causes the toggle to remain open, and which enables the user not only to lower the action merely by putting the safety lever on "safe" but thereafter to fire any remaining bullets in the magazine by returning the safety lever to firing position.

It is yet another object of the invention to provide a toggle release which remains inactive during the course of firing the gun, but which is automatically placed in operative condition when the toggle is retained in open position so that toggle release can be effected merely by moving the thumb safety lever to "safe" position, a movement which a right-handed person can perform single-handedly.

It is a further object of the invention to provide a toggle release mechanism which is safe and reliable, has but a minimum of parts to get out of order and renders a Luger pistol Model P.08 more modern and efficient.

It is an additional object of the invention to provide a generally improved toggle release for a Model P.08 Luger pistol.

Other objects, together with the foregoing ar attained in the embodiment described in the following description and illustrated in the accompanying drawings.

Figure 1:
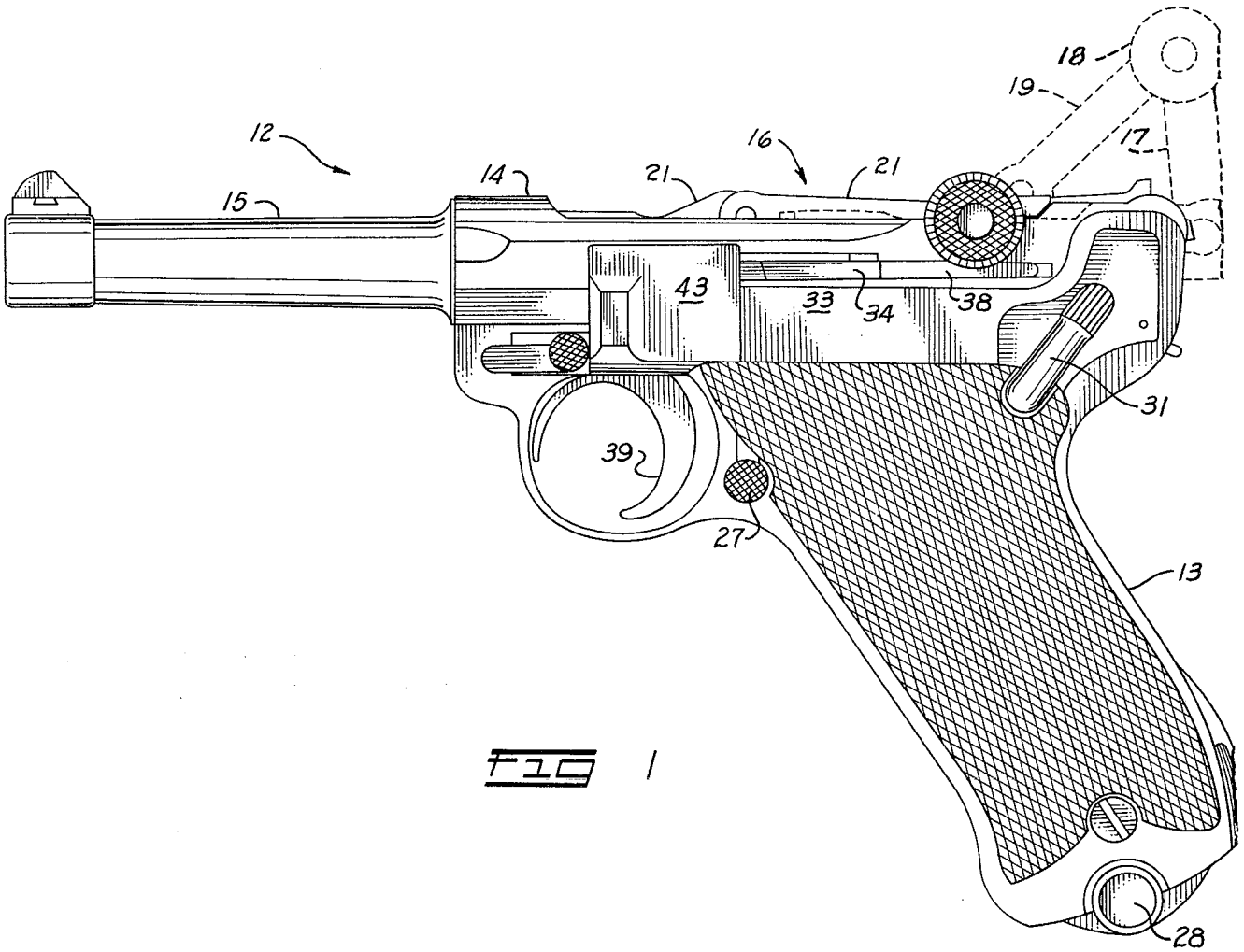
FIG. 1 is a side elevational view of a Model P.08 Luger pistol showing the position of a closed toggle in full line and the position of an open toggle in broken line.

While the toggle release mechanism of the invention is susceptible of numerous different physical embodiments, depending upon the environment and requirements of use, substantial numbers of the herein shown and described embodiment have been made, tested and used, and all have performed in an eminently satisfactory manner.

The mechanism of the invention, generally designated by the reference numeral 11, finds particular utility in a Model P.08 Luger pistol 12 which includes, in well known fashion, a handle 13, a frame 14, or barrel extension, and a barrel 15.

One of the unique characteristics of the pistol is the toggle train mechanism 16 including a pivoted after lever 17, pivoted toggle knobs 18, pivoted forward lever 19 and slidable shoe 21 which carries the breech block 22, as well as the extractor and firing pin. The shoe and the attached breech block slide in longitudinal guide slots on opposite frame side rails 24. This structure is conventional and is therefore neither shown nor described in detail.

The gun also includes a magazine 26 which is slidably mounted in the handle 13, the magazine being held in place by a magazine latch released by laterally depressing a stud 27. Finger grips 28 on the lower end of the magazine facilitate removal.

Inside the magazine is a spring biased follower 29, or platform, which urges the superposed shells upwardly so that when the toggle train 16 closes, the breech block 22 abuts and urges the topmost cartridge out of the magazine and forwardly into the firing chamber 20 at the base of the barrel 15. The extractor then locks in the cannelure of the cartridge case and the gun is in firing condition.

Figure 2:
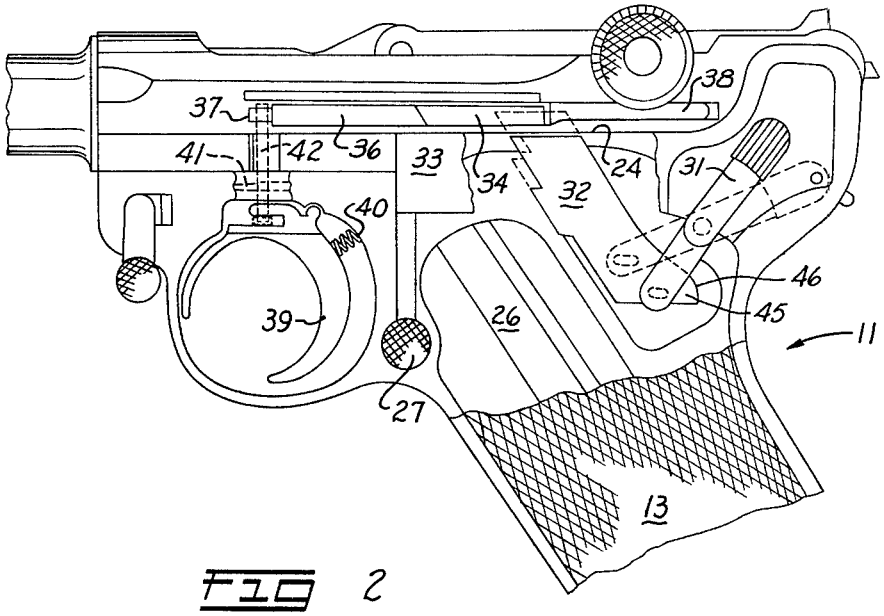
FIG. 2 is a fragmentary side elevational view with the cover plate remove and with portions broken away to show the construction and operation of the modified form of sear bar slide and thumb safety lever in locking the trigger mechanism as the safety lever is moved from "fire" position, shown in full line, to "safe" position, shown in broken line.

A thumb safety lever 31 is pivotally mounted on the frame 14 and is movable between the "fire" position shown in full line in FIG. 2 and the "safe" or "Gesichert" or "Made safe" position shown in broken line. Movement of the safety lever 31 between the two positions causes a corresponding translation of a sear bar slide 32 which is movable in a channel 30 formed in the adjacent frame side rail 24.

When the safety lever is in "fire" position the sear bar slide 32 is in lowermost, or retracted, position, as indicated in full line.

However, when the safety lever 31 is moved to "safe" position, the sear bar slide 32, which is in pivotal engagement with the lever 31, is translated upwardly so as to project above the frame side rail 24 and cover the after end 34 of the horizontal firing pin release lever 36, thereby immobilizing the lever 36 and associated firing pin mechanism, in well known manner.

The firing pin release lever 36 is pivotally mounted on a vertical pivot, the forward end of the lever 36 terminating in a pressure pin 37 biased laterally outwardly by a leaf spring 38 bearing laterally inwardly on the after end of the lever 36.

When the trigger 39 is "pressed" rearwardly against the spring 40 a linkage 41 urges a vertical bar 42, which is pivotally mounted on the inside wall of a cover plate 43, laterally inwardly against the pressure pin 37, in opposition to leaf spring 38. Inward displacement of the pressure pin 37 is followed by release of the firing pin, or striker, and consequent firing of the gun.

Immobilization of the firing pin release lever 36 by the sear bar slide 32, in other words, "locks" the trigger 39.

Upward translation of the sear bar slide 32, caused by moving the gun safety lever 31 into "safe" position concurrently actuates the toggle release mechanism, generally designated by the reference numeral 44.

Figure 3:
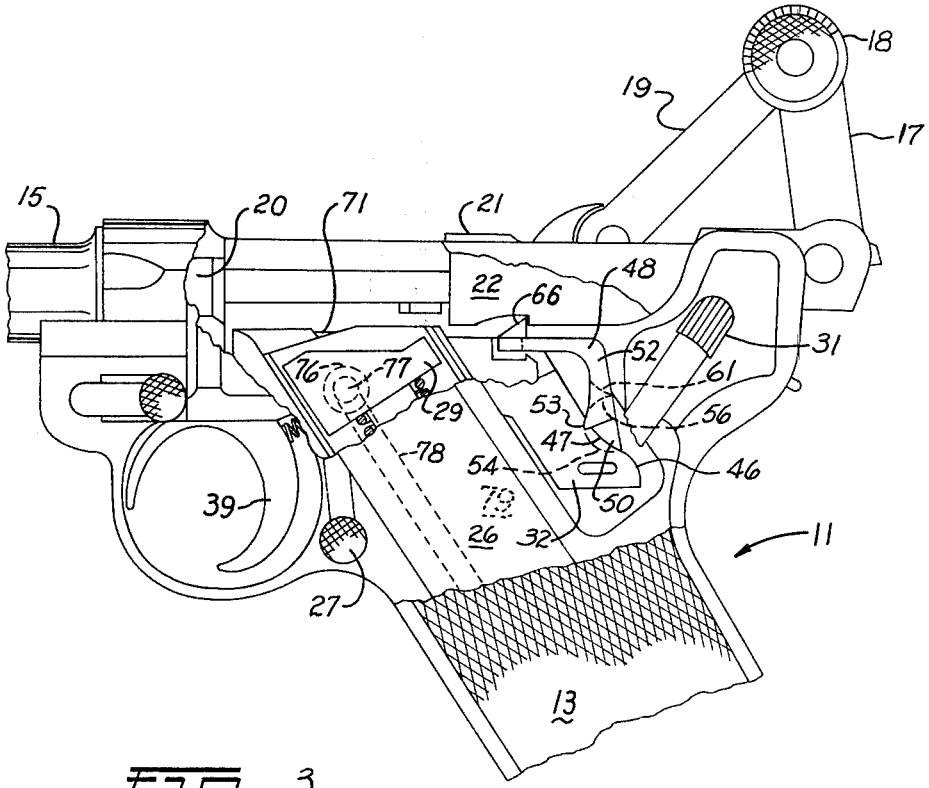
FIG. 3 is a view comparable to FIG. 2 but with additional portions broken away to show the magazine follower with the stud which abuts and elevates the hold open catch lever when the magazine is empty, and showing the relationship of the release lever, sear bar slide, catch and breech block with the toggle assembly in open position.
Figure 4:
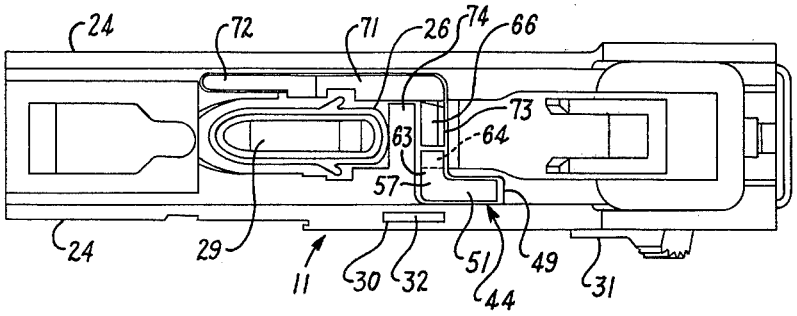
FIG. 4 is a fragmentary top plan view of the gun with the barrel, barrel extension and toggle assembly removed.

The lower after end of the sear bar slide 32 is arcuately contoured, as appears in FIGS. 2 and 3, to provide a camming surface 46 in engagement with the arcuate surface 47 formed on the lower end 50 of an L-shaped release lever 48.

The release lever 48 is disposed, for the most part in a vertically milled slot 49 in the frame side rail 24 adjacent but spaced a short distance inwardly and rearwardly from the channel 30 occupied by the sear bar slide 32.

The Model P.08 pistol as manufactured does not have the slot 49 and it is therefore necessary to mill this opening in the frame side rail 24 to receive the lever 48.

The release lever 48 includes a generally horizontal fore and aft arm 51 and a generally vertical arm 52, the lower end of the vertical arm 52 being formed so as to provide not only the arcuate cam engaging surface 47 but also an outer flange 53 and an inner flange 54, the two flanges 53 and 54 slidingly embracing opposite sides of the sear bar slide 32 and thereby providing a track-like structure which allows relative sliding motion between the surfaces 46 and 47 but which restrains the lever 48 from relative lateral motion with respect to the sear bar slide 32.

When the sear bar slide 32 translates upwardly, the camming surface 46 on the sear bar slide engages and urges the lower end 50 of the release lever 48 in a rearward direction. Owing to the presence of an inwardly projecting arcuate shouler 56 on the inner side of the lower end 50 in the vicinity of and slightly above the inner flange 54, a pivoting action is also attained, thereby urging the forward end 57 of the fore and aft arm 51 in a downward direction.

The pivoting action occurs at the contact between the upwardly facing arcuate shouler 56 on the release lever 48 and the overlying under surface of the adjacent arcuate ledge 61 present in the existing gun frame. Thus, as the camming surface 47, which possesses both vertically upward and horizontally rearward components, moves upwardly and forwardly when the sear bar slide is translated into "safe" position, the vertical arm 52 of the release lever 48 is urged first upwardly so that the shoulder 56 engages the overhanging ledge 61. Further upward movement of the sear bar slide 32 then cams the lower end 50 of the lever 48 in an after direction. By bell-crank action the lever 48 then rocks about the contact between shoulder 56 and ledge 61 as a pivot, thereby depressing the forward end 57 of the horizontal arm 51 of the release lever 48.

At the forward end 57 of the arm 51 there is provided a laterally inwardly extending finger 63 terminating in a stepped projection 64 overlying a corresponding stepped shelf 65 formed by machining a portion of an adjacent hold open latch 66, or catch, or detent, capable of restraining the toggle train in open position under the circumstances shortly to be described.

When the forward end 57 of the horizontal arm 51 of the release lever is depressed, the stepped projection 64 on the lateral finger 63 forcefully urges the shelf 65 on the latch downwardly, threby withdrawing the hold open latch 66 from the notch in the bottom of the overlying breech block 22 and permitting the main recoil spring to close the toggle action 16.

The toggle train mechanism 16 is held open after firing under either of the following circumstances: (1) when the last cartridge has been fired and the empty shell casing has been withdrawn from the firing chamber and ejected by the extractor as the toggle opens; or (2) a weak, or malfunctioning, hold open latch spring which allows the latch to protrude upwardly into the breech block notch, thereby permitting the latch to interfere with the return of the breech block.

The hold open latch 66 is mounted transversely on the after end of a hold open latch lever 71, the forward end of the lever 71 being attached to the after end of a leaf spring 72. The spring 72 biases the lever 71 downwardly so that under normal firing conditions the latch 66 occupies a recess 73 formed in a transverse web 74 spanning the opposite frame side rails 24.

Should the hold open latch lever spring 72 become weak, or function improperly, causing the latch 66 to protrude upwardy beyond the upper margins of the latch recess 73, the latch will interfere with the return of the breech block and thereby hold the toggle assembly in open position.

In like manner, when the last round has been removed from the magazine 26, the spring-urged follower 29 ascends into its uppermost position, carrying with it a follower button 76, or stud, which is connected to the follower 29 by a post 77 protruding laterally through an elongagted slot 78 in the nether side wall 79 of the magazine.

In moving into uppermost position, the button 76 engages the bottom edge of the latch lever 71; and since the force exerted upwardly by the helical follower spring 81 is greater than the downward force of the latch lever leaf spring 72, the latch 66 is elevated above the margins of the latch recess 73, thereby interfering with closure of the toggle assembly.

It will be noted, at this juncture, that the latch 66 and the notch 67 in the breech block 22 are so contoured that when the breech block retracts after firing, the latch 66 is momentarily depressed out of the way while the breech block wipes over it; but after the breech block continues to move rearwardly, the latch 66 again rises to interfere with and bar the return of the breech block owing to the projection of the latch tip 83 upwardly into the notch 67, in the manner of a latch and strike plate in a door lock.

By pressing or forcing the latch 66 downwardly into its recess 73, the latch tip 83 is disengaged from the notch 67, allowing the recoil spring to close the action and lock the breech block.

Figure 5:
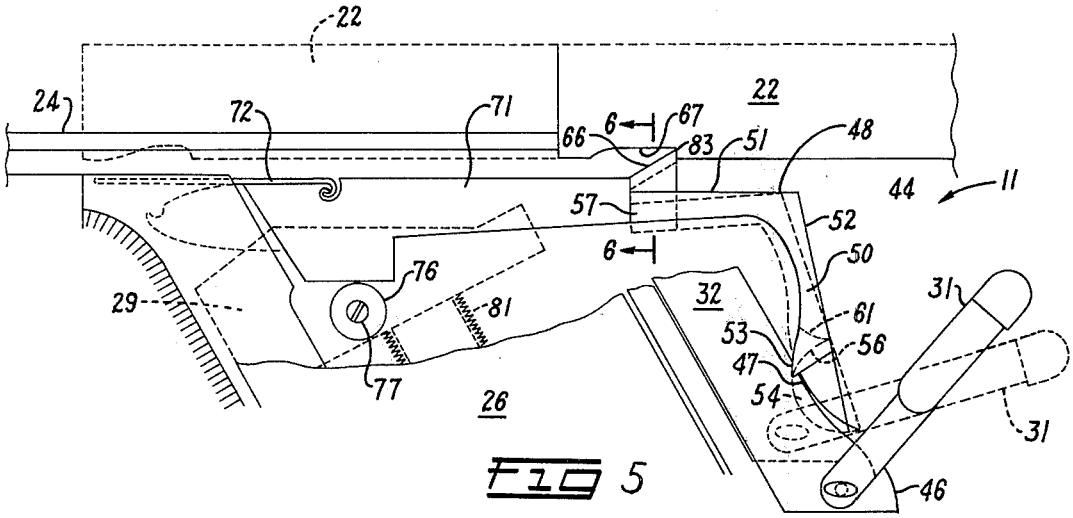
FIG. 5 is a fragmentary side elevational view, to an enlarged scale, and with portions broken away, showing the relative locations of the catch mechanism, th catch release structure, the sear bar slide and the thumb safety lever in the two extreme positions of the foregoing components; and, FIG. 6 is a fragmentary transverse sectional view, to a greatly enlarged scale, of the forward end of the overlying portion of the catch release lever and the underlying portion of the catch lever, the section being taken on the line 6 — 6 in FIG. 5.
Figure 6:
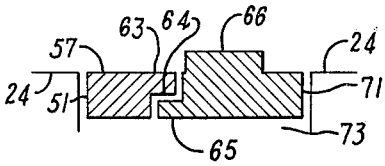

The latch 66 is selectively retracted in the manner previously described, namely, by switching the gun safety lever 31 from "fire" to "safe" position which, in turn, rocks the release lever 48 in a counterclockwise direction, as viewed in FIGS. 3 and 5. This action depresses the finger 63 and urges the latch 66 downwardly against the upward urgency of the follower spring 81, thereby releasing the breech block and allowing the toggle to close.

As an additional advantage the foregoing "safe" lever movement is automatically accompanied by placing the gun in the "safety" mode, thereby preventing premature or accidential firing.

Thereafter, by removing the empty magazine and replacing it with a magazine having one or more cartridges therein, followed by retracting and releasing the toggle and switching the safety lever 31 to "fire" position, firing can be resumed.

In the infrequent but possible alternative situation where the toggle is held open as a result of a malfunctioning latch spring (which can occur even when the magazine is not empty) the movement of the safety lever to "safe" position as previously described, will release the toggle and allow the action to close. Then, by returning the safety lever to "fire" position, firing can be resumed, bearing in mind that spring replacement is indicated.

What is claimed is:

1. In a Model P.08 Luger pistol including a frame, a toggle assembly having a breech block, a hold open latch mechanism including a catch biased downwardly by a latch spring, the catch being movable between an upper projected position engageable with the breech block and a lower retracted position removed from the breech block, a magazine including a follower spring and a stud capable of moving the catch from lower retracted position into upper projected position when the magazine is empty, a sear bar slide, and a thumb safety lever pivotally connected with the sear bar slide for selective movement of the sear bar slide between a lower "fire" position and an upper "safe" position, a toggle release and trigger lock comprising:

a. an L-shaped bell crank including a generally horizontal fore and aft arm extending to a forward end overlying a portion of the catch and generally vertical leg extending downwardly to a lower end engageable with the after edge of the sear bar slide, said bell crank being fulcromed on said frame for rocking movement between a first location in which said forward end of said fore and aft arm imposes no force on the underlying catch portion and a second location in which said forward end biases the catch downwardly from said upper projected position to said lower retracted position wherein the breech block is released and the toggle assembly is free to move forwardy to closed position; and, b. a camming member carried on the sear bar slide for camming engagement with said lower end of said vertical leg of said bell crank, the after edge of said camming member being so contoured that in said lower "fire" position of said sear bar slide said bell crank is positioned in said first location and in said upper"safe" position of said sear bar slide said bell crank is positioned in said second location.

2. The combination as in claim 1 in which said lower end of said vertical leg includes flanges projecting forwardly to embrace the adjacent portion of said camming member and thereby prevent the lateral displacement of said vertical leg relative to said camming member.

3. The combination as in claim 2 in which said lower end of said vertical leg includes a laterally projecting shouler affording an upwardly facing surface in fulcromed engagement with the downwardly facing surface of an overhanging ledge formed in the gun frame, said camming member being effective upon preliminary elevation of the sear bar slide to urge said shoulder upwardly against said ledge and upon further elevation to rock said lower end of said vertical leg rearwardly with supervening force and thereby depress said forward end of said forward leg and the underlying catch portion into lower retracted position in opposition to the upward urgency of the follower spring in the magazine.

* * * * *